US007934941B2

(12) United States Patent
Hayauchi

(10) Patent No.: US 7,934,941 B2
(45) Date of Patent: May 3, 2011

(54) INSULATION DISPLACEMENT CONNECTOR WITH WIRE HOLDER

(75) Inventor: Takayuki Hayauchi, Tokyo (JP)

(73) Assignee: 3M Innovative Properties Company, St. Paul, MN (US)

( * ) Notice: Subject to any disclaimer, the term of this patent is extended or adjusted under 35 U.S.C. 154(b) by 138 days.

(21) Appl. No.: 12/377,033

(22) PCT Filed: Aug. 23, 2007

(86) PCT No.: PCT/US2007/076647

§ 371 (c)(1),
(2), (4) Date: Feb. 10, 2009

(87) PCT Pub. No.: WO2008/024916

PCT Pub. Date: Feb. 28, 2008

(65) Prior Publication Data

US 2010/0167579 A1 Jul. 1, 2010

(30) Foreign Application Priority Data

Aug. 25, 2006 (JP) ..... 2006-229149

(51) Int. Cl.
*H01R 4/24* (2006.01)

(52) U.S. Cl. ..... 439/417

(58) Field of Classification Search ..... 439/404, 439/405, 417, 460

See application file for complete search history.

(56) References Cited

U.S. PATENT DOCUMENTS

| | | | | |
|---|---|---|---|---|
| 4,995,827 | A * | 2/1991 | Rudoy | 439/405 |
| 5,030,133 | A * | 7/1991 | Rudoy | 439/409 |
| 5,118,310 | A * | 6/1992 | Stroede et al. | 439/676 |
| 5,316,504 | A | 5/1994 | Jinno | |
| 5,520,550 | A * | 5/1996 | Okabe | 439/404 |
| 5,676,554 | A | 10/1997 | Tsuji | |
| 5,915,990 | A * | 6/1999 | Beer et al. | 439/417 |
| 7,074,093 | B2 * | 7/2006 | Saka et al. | 439/724 |

FOREIGN PATENT DOCUMENTS

| | | |
|---|---|---|
| JP | 05326060 | 12/1993 |
| JP | 08315930 | 11/1996 |
| JP | 18073502 | 3/2006 |

* cited by examiner

*Primary Examiner* — Neil Abrams
(74) *Attorney, Agent, or Firm* — Johannes P. M. Kusters

(57) ABSTRACT

The present invention relates to an insulation displacement connector. One embodiment includes an insulation displacement terminal in which wire insulation displacement portions, to be electrically connected to wire, are formed by cutting and folding, a connector housing for holding the insulation displacement terminal therein and having a holder opening in an area in which the wire insulation displacement portion of the insulation displacement terminal are located, and a wire holder having a pair of upper and lower covers capable of being assembled together by being mounted to the holder opening, wherein the lower cover includes a rotary piece rotatable inward about a proximal end thereof when the lower cover is assembled with the upper cover to clamp or to provide strain relief for the wire in association with the upper cover.

5 Claims, 6 Drawing Sheets

INSULATION DISPLACEMENT CONNECTOR WITH WIRE HOLDER

CROSS REFERENCE TO RELATED APPLICATIONS

This application is a national stage filing under 35 U.S.C. 371 of PCT/US2007/076647, filed Aug. 23, 2007, which claims priority to Japanese Application No. 2006-229149, filed Aug. 25, 2006, the disclosure of which is incorporated by reference in its/their entirety herein.

TECHNICAL FIELD

The present invention relates to an insulation displacement connector wherein insulation displacement terminals are held in a connector housing, each having a wire insulation displacement portion formed at one end and an electrical contact portion at the other end.

BACKGROUND

There is a kind of insulation displacement connectors having insulation displacement terminals, supplied by a maker to a user after being sub-assembled, and connected via the insulation displacement terminals to electrical wire on the user side before using. Generally, connecting methods have been required for such insulation displacement connectors, which are easily connectable while maintaining a high reliability of electrical connection. It is important for the purpose of enhancing the reliability of electrical connection that the electrical wire does not slide out of the connector when an unintentional external force is applied to the electrical wire, and for the purpose of facilitating the ease of electrical connection that the mutual connection between the electrical wire and the terminal is possible with a small amount of labor providing favorable operability.

One example of such kinds of insulation displacement connectors is disclosed in Japanese Unexamined Patent Publication No. 2003-173827. As shown in FIG. 11, this insulation displacement connector 60 includes insulation displacement terminal 61 having a wire insulation displacement portion 61*a* formed by cutting and folding for electrical connection to a core wire of an electrical wire 67, a connector housing 62 for holding the insulation displacement terminal 61 and having an opening 62*a* at a position corresponding to the wire insulation displacement portion 61*a* of the insulation displacement terminal 61, and a wire holder 63 having a pair of upper and lower covers 64, 65 assembled to each other by being pushed into the opening 62*a* so that the electrical wire 67 is held between the pair of upper and lower covers 64, 65. Crank-like stepped portions 64*a* and 65*a* are formed on the opposite surfaces of the covers 64, 65 at a wire-inserting end thereof so that the electrical wire 67 is carved to be a crank shape by the stepped portions 64*a* and 65*a* when the upper and lower covers 64, 65 are assembled with each other, whereby the electrical wire 67 is not unintentionally slid out of the wire holder 63.

In the insulation displacement connector 60 disclosed in Japanese Unexamined Patent Publication No. 2003-173827, as a wire inserting opening 66 on a wire-inserting side of the wire holder 63 becomes narrow due to the crank-shaped stepped portions 64*a*, 65*a*, a careful operation is necessary when the electrical wire 67, which has a tendency of twisting or bending, is inserted, so that the inserted end of the electrical wire is not brought into contact with the stepped portions 64*a* and 65*a*. Also, size of the electrical wire is limited to facilitate the insertion of the electrical wire 67 into the wire holder 63 and to prevent the electrical wire 67 from sliding out of the connector. When thin electrical wire (small-diameter wire), particularly those having an outer diameter of 1 mm or less are used, a wire clamping-force is weak in the wire insulation displacement portion and therefore, a connector capable of more assuredly clamping the wire has been required.

SUMMARY

In view of the above-mentioned problems, an object of the present invention is to provide an insulation displacement connector capable of smoothly inserting an electrical wire into a clearance between a pair of upper and lower covers in a wire holder and assuredly preventing the electrical wire from sliding out of the insulation displacement connector.

To solve the above-mentioned problems, an insulation displacement connector defined by claim 1 comprises an insulation displacement terminal in which a wire insulation displacement portion, to be electrically connected with an electrical wire, is formed by cutting and folding, a connector housing for holding said insulation displacement terminal therein and having an opening in an area in which said wire insulation displacement portion is located, and a wire holder having a pair of upper and lower covers capable of being assembled together by being mounted to said opening and holding said electrical wire between said pair of upper and lower covers, wherein said lower cover comprises a rotary piece attached thereto, said rotary piece being configured to rotate inward about a proximal end of said lower cover when said lower cover is assembled with the upper cover so as to cooperate with said upper cover to clamp said electrical wire therebetween.

The invention defined by claim 2 is an insulation displacement connector as defined by claim 1, wherein said rotary piece is attached to an end of said lower cover on the wire-inserting side via a flexible hinge.

The invention defined by claim 3 is an insulation displacement connector as defined by claim 1 or 2, wherein said rotary piece comprises a projection projected from the inner surface of said rotary piece toward said upper cover, and said upper cover comprises a receiving groove provided in said upper cover for clamping said electrical wire in association with said projection when said upper cover is assembled with said lower cover.

The invention defined by claim 4 is an insulation displacement connector as defined by claim 3, wherein said receiving groove comprises a recess provided in part of a groove surface in said receiving groove at a position with reference to said projection.

The invention defined by claim 5 is an insulation displacement connector as defined by claim 3 or 4, wherein said projection and said receiving groove are shallowly intermeshed with each other before said upper and lower covers are assembled together.

The invention defined by claim 6 is an insulation displacement connector as defined by any one of claims 1 to 5, wherein said lower cover comprises a pair of holding pieces provided at an innermost end of said lower cover in the wire-inserting direction, for temporarily fixing said electrical wire inserted between said upper and lower covers.

DETAILED DESCRIPTION

Figure 1:
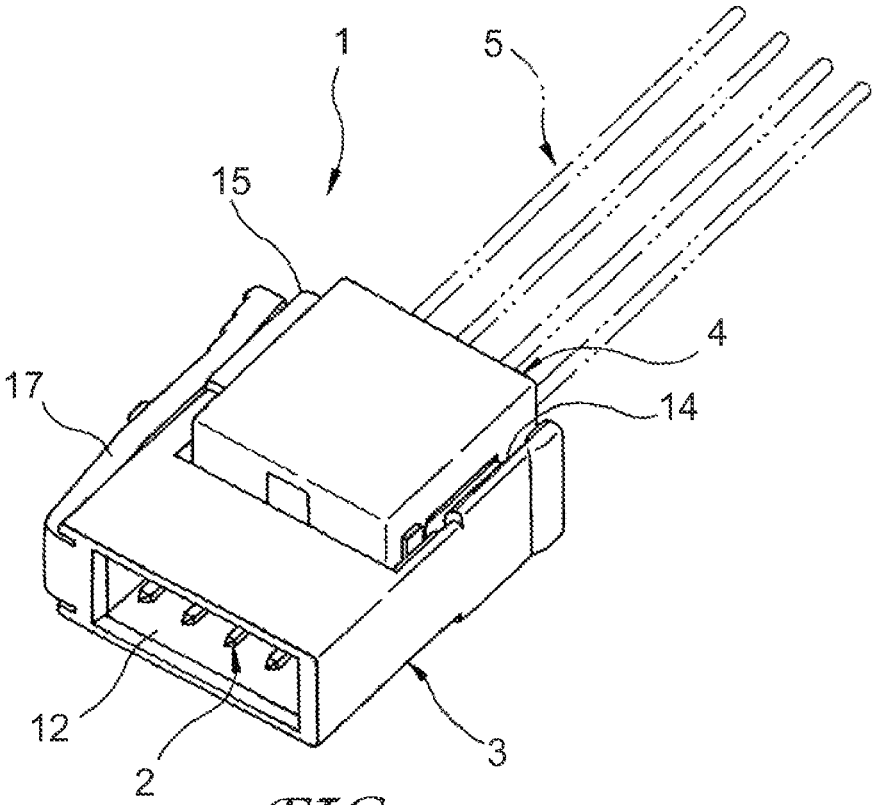
FIG. 1 A perspective view of one embodiment of the inventive insulation displacement connector as seen from the connector-fitting portion.

According to the invention defined by claim 1, as the rotary piece is attached to the lower cover to rotate inward about a proximal end of the lower cover when the lower cover is assembled with the upper cover so as to cooperate with the upper cover to clamp the electrical wire therebetween so that a wire-inserting side of the wire holder is open before the pair of upper and lower covers are assembled together, it is possible to smoothly insert the electrical wire into the wire holder through the wire inserting port of the wire holder. When the rotary piece has been made to rotate after the assembly of the upper and lower covers, the electrical wire is clamped between the upper cover and the rotary piece to be prevented from sliding out of the wire holder. Accordingly, it is possible to smoothly insert the wires even if they are thin and have a tendency of twisting or bending. In addition, as a wire-pressing portion of the rotary piece can be enlarged in size as large as possible until the operation is disturbed, it is possible to prevent thin wire from sliding, or being dislodged, out of the wire holder.

According to the invention defined by claim 2, as the rotary piece is attached to an end of the lower cover on the wire-inserting side via the flexible hinge, it is possible to rotate the rotary piece in association with the assembling operation of the upper and lower covers. Also, the number of parts constituting the connector can be reduced.

According to the invention defined by claim 3, as the projection is provided on the inner surface of the rotary piece and the receiving groove is formed in the upper cover for clamping the electrical wire in association with the projection, the electrical wire inserted into the wire holder is positioned in the radial direction by the receiving groove, and the projection of the rotary piece presses the electrical wire in the radial direction. Accordingly, it is possible to press a center of the wire with the rotary piece whereby the wire can more assuredly not be slid out of the wire holder.

According to the invention defined by claim 4, as the recess is provided at a position corresponding to the projection of the rotary piece in a part of the groove surface of the receiving groove, the pressed portion of the electrical wire is accommodated in the recess and carved to be an angled-shape when the electrical wire is pressed by the projection upon the assembly of the upper and lower covers. Accordingly, the pressed portion of the electrical wire makes contact with the projection and opposite edge portions at three points, whereby the electrical wire is favorably caught and effects of the invention is enhanced.

According to the invention defined by claim 5, as the projection of the rotary piece and the receiving groove of the upper cover are shallowly intermeshed with each other before the assembly of the upper and lower covers, it is possible to prevent the wire inserted into the individual wire-inserting port of the wire holder from not being lined up. Thus, the connecting operation of the connector and the wire is facilitated.

According to the invention defined by claim 6, as the pair of holding pieces are projected at the innermost end of the lower cover as seen in the wire-inserting direction, it is possible to temporarily fix the electrical wire by the pair of holding pieces before the assembly of the upper and lower covers, whereby the electrical wire is prevented from unintentionally sliding out of the wire holder during the operation. The connection operability of the connector with the electrical wire is improved also thereby.

Figure 2:
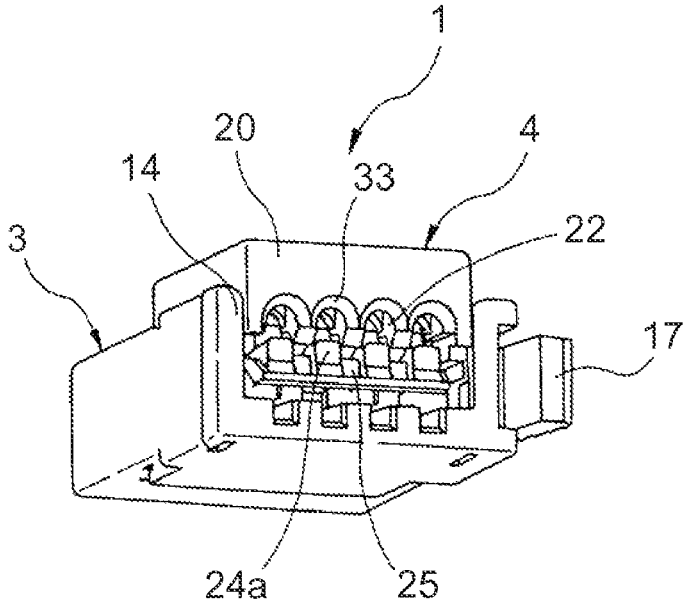
FIG. 2 A perspective view of the embodiment of the inventive insulation displacement connector as seen from the wire-inserting side.

The preferred embodiments of the present invention will be described below in detail with reference to the attached drawings wherein the same reference numerals are used for indicating common parts and the redundant explanation thereof will be eliminated. FIGS. 1 and 2 are perspective views illustrating one embodiment of an insulation displacement connector according to the present invention, wherein FIG. 1 is the illustration as seen from a side on which the connector is fitted and FIG. 2 is the illustration as seen from a side on which electrical wire is inserted.

As illustrated, the insulation displacement connector 1 according to this embodiment can be used with a device having a power wire and a signal wire connected with an instrument. Especially, this connector 1 is suitably used to connect a device with wires such as relatively thin wires (electrical wires). For example, this connector 1 is used to connect a sensor and a measuring instrument (not shown) installed on a production line. This connector 1 has insulation displacement terminals 2, each having an electrical contact portion 6 at one end and a U-shaped wire insulation displacement portion 9 at the other end, a connector housing 3 for holding four insulation displacement terminals 2 arranged lateral to each other, having a connector-fitting portion 12 on a side on which the electrical contact portions 6 of the insulation displacement terminals 2 are located and a holder opening 14 in an area wherein the wire insulation displacement portion 9 is positioned, a wire holder 4 including a pair of upper and lower covers 20 and 21 assembled to each other by being mounted to the holder opening 14 for the purpose of holding electrical wire 5 between the upper and lower covers 20, 21, and the electrical wire 5 being press-contacted with the insulation displacement terminal 2 while being held by the wire holder 4.

In general, the size of the insulation displacement connector varies in accordance with the size of the wire applied thereto. The insulation displacement connector according to this embodiment may be provided as those applicable to an electrical wire, for example, having an outer diameter of 1 mm or less.

The insulation displacement terminal 2 may be formed as a one-piece body by being punched out from an electro-conductive substrate and then folding to have a desired shape. It has a tab-like electrical contact portion 6 for electrically connecting to a female type terminal in a corresponding female connector (not shown) at one end. At the other end it has a U-shaped wire insulation displacement portion 9 formed by cutting a wide end portion of terminal 2 to form slit 10*a* and folding insulation displacement 9 vertically upward to have a pair of insulation displacement edges 10, 10 on either side of slit 10*a*. On a root portion of the electrical contact portion 6, a terminal press-fit portion 7 (see FIG. 8) having a large width is formed and a stopper portion 8 (see FIG. 8) is formed adjacent thereto. The terminal press-fit portion 7 is to be press-fit into a press-fit aperture 13*a* formed in a partition wall 13 of the connector-fitting portion 12. The stopper portion 8 is to position the insulation displacement 2 in a press-fit direction. The electrical wire 5 held by the wire holder 4 is press-fit into a slit 10*a* (see FIG. 3) between the pair of edges 10, 10 from above, when the wire holder 4 is pushed into the holder opening 14 of the connector housing 3 by using a hand tool or others, for example, with a predetermined force relating to the press-contact force, whereby a covering 5*a* is cut to expose a wire core which is then electrically connected to the inner surface of the slit 10*a*.

Figure 3:
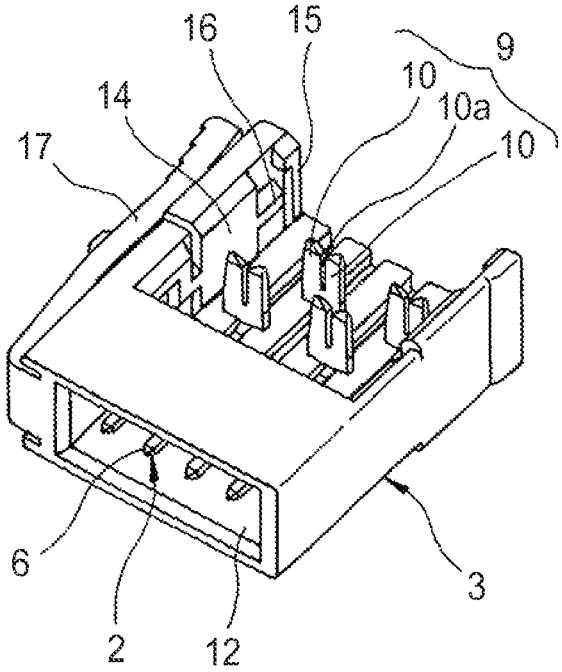
FIG. 3 A perspective view of a connector housing for the insulation displacement connector.

As shown in FIG. 3, the connector housing 3 is molded with resinous material excellent in moldability, thermal durability or others to have a rectangular frame shape. It has, on a front side, the connector-fitting portion 12 forwardly projected around the electrical contact portion 6 of the insulation displacement terminal 2 in the opening, and on a rear side, the holder opening 14 wherein the wire insulation displacement portion 9 of the insulation displacement terminal 2 is projected upward. Into the connector-fitting portion 12, the corresponding connector-fitting portion of the mating connector is fitted. The holder opening 14 is a part on which the wire holder 4 described later is mounted, and provided with a locking claw 16 on the inner surface of side walls 15 (shown only on one side in FIG. 3) to be engaged with a locking hook 35*a* (shown in FIG. 6) of the wire holder 4.

The four insulation displacement terminals 2 are arranged in the connector housing 3 on a lateral line at a predetermined pitch. The large width wire insulation displacement portions 9 in the adjacent insulation displacement terminals 2 are arranged in a staggered manner not to interfere with each other. By such a staggered arrangement of the wire insulation displacement portions 9, it is possible to dispose the adjacent insulation displacement terminals 2 at a narrow pitch and thereby to minimize the size of the connector. The wire insulation displacement portion 9 projected vertically upward in the holder opening 14 is adapted to pass through an aperture 32 formed in a bottom wall 28 of the lower cover 21 in the wire holder 4 and be brought into press-contact with the wire 5 held by the wire holder 4.

A lock arm 17 is formed in an outside wall 15 of the connector housing 3 to be a one-piece body as the former. The lock arm 17 is adapted to be engaged with a locking portion formed in a wall of a female type connector not shown to retain a locked state between both the connectors. To release the locked state, the lock arm 17 is made to flex inward about a proximal end thereof.

Figure 4:
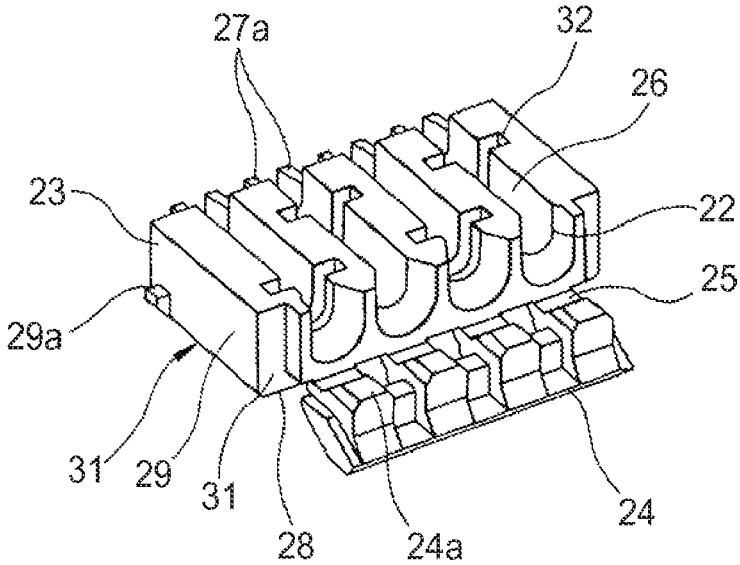
FIG. 4 A perspective view of a lower cover in the wire holder of the insulation displacement connector.
Figure 5:
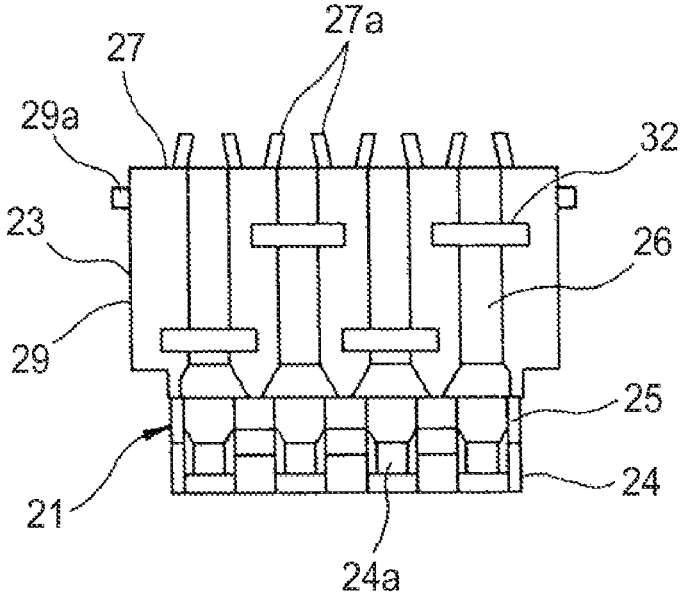
FIG. 5 A plan view of the lower cover shown in FIG. 3.
Figure 6:
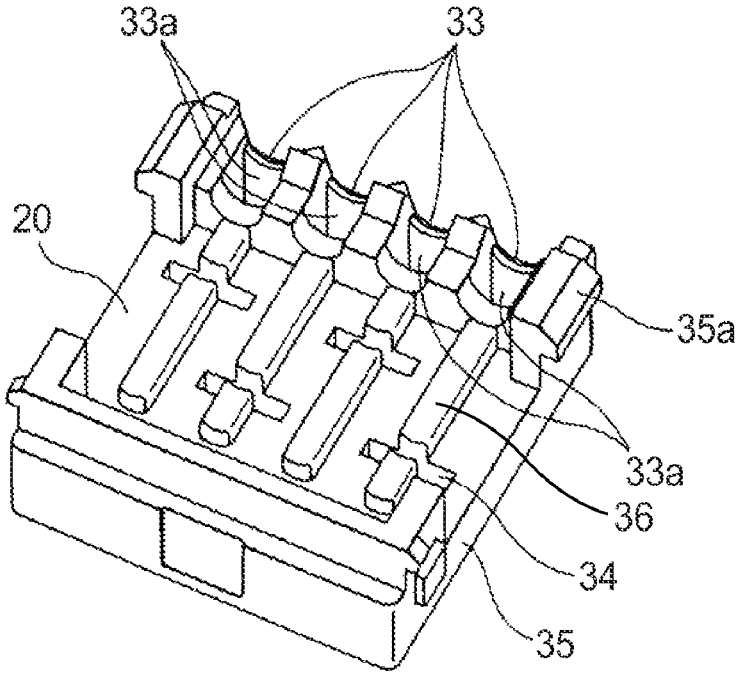
FIG. 6 A perspective view of an upper cover in the wire holder of the insulation displacement connector.
Figure 7:
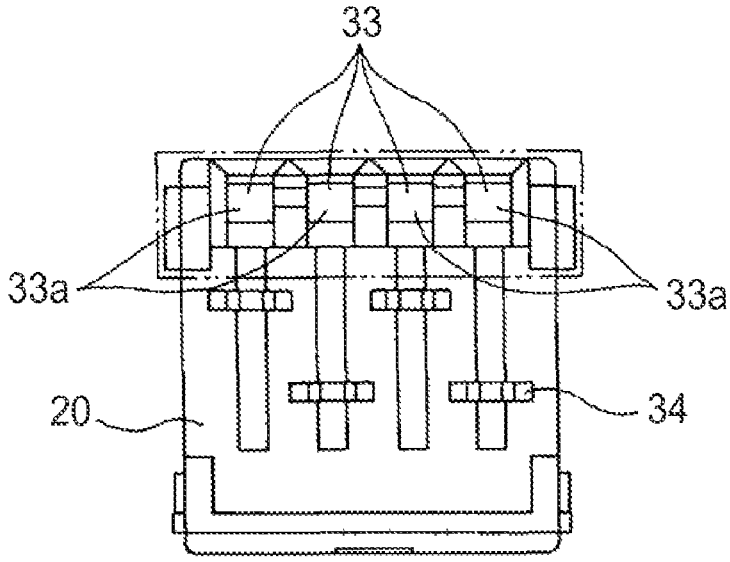
FIG. 7 A plan view of the upper cover shown in FIG. 5.

The wire holder 4 is constructed by the lower cover 21 shown in FIGS. 4 and 5 and the upper cover 20 shown in FIGS. 6 and 7. The upper and lower covers 20, 21 are temporarily fixed to the holder opening 14 of the connector housing 3 while tentatively assembled together to have a clearance between the covers 20 and 21 allowing the wires 5 to be inserted through the clearance. After the wires 5 have been inserted through wire-inserting ports 22 while the clearance exists between the covers 20 and 21, the wire holder 4 is pushed into the holder opening 14 by using, for example, a hand tool, the clearance between the covers 20, 21 is eliminated whereby the upper and lower covers 20, 21 are completely assembled and fastened to each other. In other words, the insulation displacement connector 1 is in a state of intermediate product before the wires 5 are inserted into the wire holder 4, and becomes a complete product after the wires 5 are inserted into the wire holder 4 and the wire holder 4 is really fixed to the connector housing 4.

As illustrated in FIGS. 4 and 5, the lower cover 21 is molded with resinous material to be of a block shape, including a cover body 23, and a rotary piece 24 coupled to a rear wall surface 31 of the cover body 23 via a flexible hinge 25.

The cover body 23 has four receiving grooves 26, each receiving an end of the wire 5 inserted from rear side. At a predetermined position of the respective receiving groove 26, there is a cavity into which the wire insulation displacement portion 9 of the insulation displacement terminal 2 is received. On a front wall surface 27 of the cover body 23, a pair of holding pieces 27*a*, 27*a* project forward to form a V-shape extending from a respective receiving groove 26. A distance between the respective pair of holding pieces 27*a*, 27*a* becomes wider as going to the ends proximal to 26 thereof and the inserted wire 5 is clamped between the distal ends of the pair of holding pieces, a distance between which is narrow. As the inserted wire 5 is clamped between the pair of holding pieces 27*a*, 27*a*, it is possible to temporarily hold the wire 5 in the wire holder 4, whereby the wire 5 is prevented from sliding out of the wire holder 4 during the operation.

On each of opposite side surfaces in the cover body 23, there is provided a locking bump 29*a* to be fitted with a hole (not shown) on the inner side surface of the upper cover 20. By the engagement of a locking bump 29*a* in the lower cover 21 with the hole in the upper cover 20, the assembled state of the upper and lower covers 20 and 21 are maintained.

Figure 8:
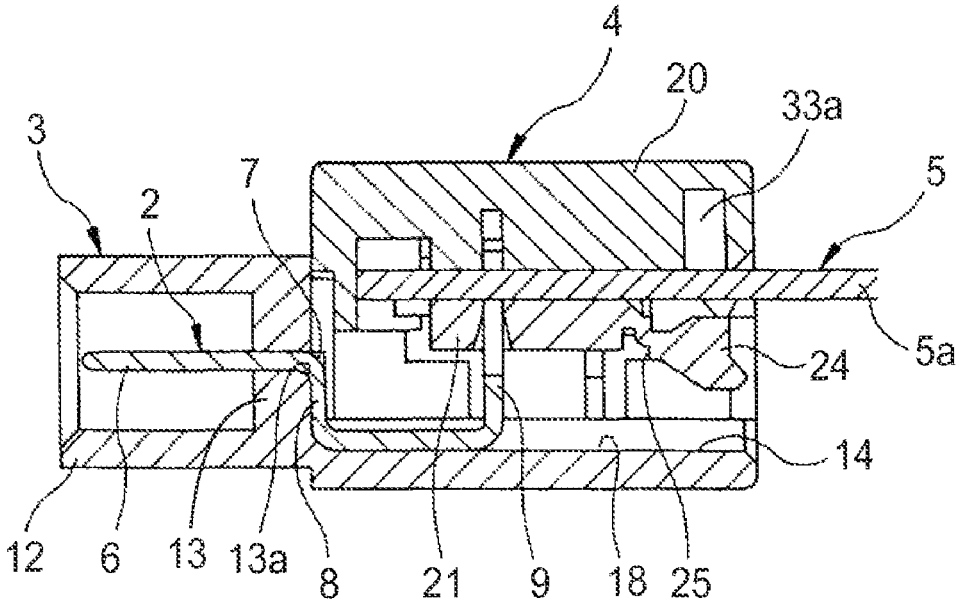
FIG. 8 A lengthwise sectional view of the inventive insulation displacement connector illustrating a state before the wire holder is mounted to the connector housing.

The rotary piece 24 may be formed as one-piece with the rear wall surface 31 of the cover body 23 via the flexible hinge 25, while being directed slightly downward not to cover the wire-inserting ports 22 of the receiving groove 26. When the rotary piece 24 is rotated inward about the hinge 25, the wires 5 are clamped between the rotary piece 24 and the upper cover 20. As shown in FIG. 8, when the upper and lower covers 20 and 21 are temporarily fixed to the connector housing 3, a distance through which the rotary piece 24 descends is defined in accordance with a clearance between the bottom wall 28 of the lower cover 21 and a wall 18 of the connector housing 3 opposed thereto. In the embodiment shown in FIG. 8, the rotary piece 24 is adapted so that a tip end thereof is not brought into contact with the wall 18 of the connector housing 3. In this regard, there is no problem even if the tip end of the rotary piece 24 is in contact with the wall 18 of the connector housing 3.

Figure 9:
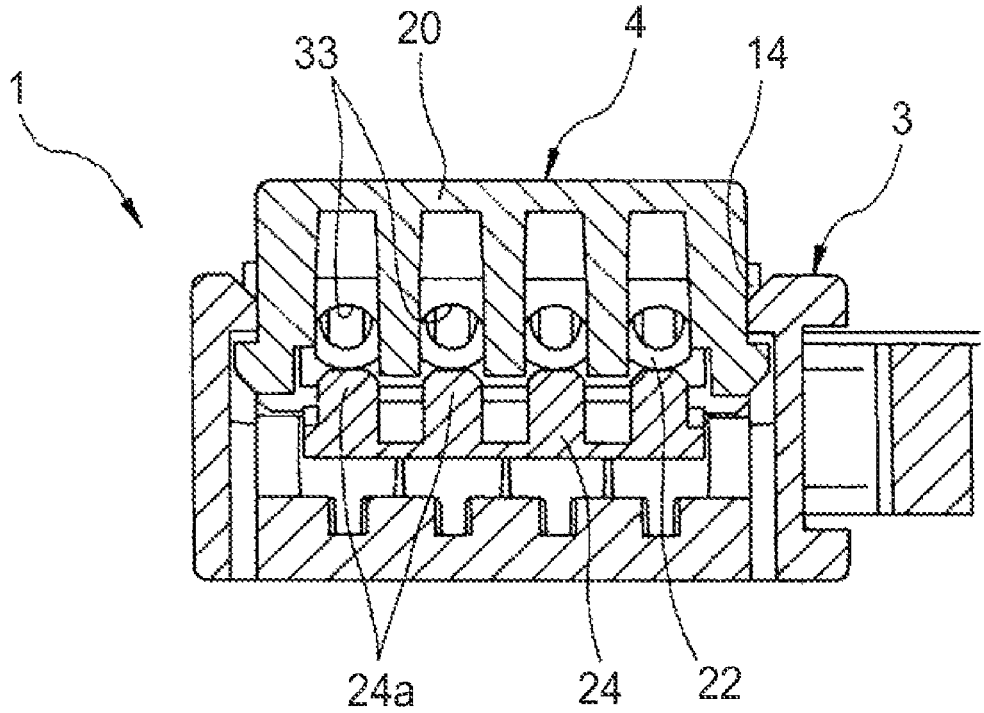
FIG. 9 A widthwise sectional view of the inventive insulation displacement connector illustrating a state before the wire holder is mounted to the connector housing.

On the inner surface of the rotary piece 24, there are projections 24*a* projected upward to press the respective wires 5. A height of the projection 24*a* may be optional because the operation for inserting the wire 5 is not interfered with the projection 24*a*, whereby the height can be selected so that a wire having a small outer diameter can be prevented from sliding out. In FIG. 9, a state is illustrated, wherein the wire holder 4 is temporarily fixed in the holder opening 14 of the connector housing 3, as seen from the wire-inserting direction. As shown, the projection 24*a* and the receiving groove 33 provided in the upper cover 20 are shallowly intermeshed with each other. Thereby, the wire 5 inserted into the wire holder 4 in the temporarily fixed state is restricted by opposite side surfaces of the receiving groove 33 from not being lined up.

Also, as the rotary piece 24 is rotatable inward about the hinge 25 from a retreated position at which it does not cover the wire-inserting port 22 of the wire holder 4 to an operational position at which it prevents the wires 5 from being slid out (see FIG. 10), the wires 5 pressed and clamped by the rotary piece 24 are put into the interior of the wire holder 4, whereby unintentional generation tension in the wires 5 can be avoided.

As shown in FIGS. 6 and 7, the receiving grooves 33 are provided in the upper cover 20 at positions opposed to the rotary piece 24 when the upper cover 20 is assembled with the lower cover 21. When the wires 5 are pushed upward by the projections 24*a* of the rotary piece 24 during the assembly of the upper and lower covers 20 and 21, the respective wire 5 is restricted by a groove surface of the receiving groove 33 from being removed or slid out of the wire holder 4.

On the inner surface of the receiving groove 33, there is recess 33*a* at positions opposed to the projections 24*a* of the rotary piece 24. If the wire 5 is clamped between the recess 33*a* and the projection 24*a* of the rotary piece 24, a part of the wire pushed by the projection 24*a* is allowed to be accommodated into the recess 33*a*, whereby the wire 5 is clamped while being curved in an angled shape. Thus, the pushed part of the wire 5 makes contact with the projection 24*a* and the opposite edge portions of the recess 33*a*, i.e. at three points, making the wire 5 difficult to be slid rearward.

There are holes 34 on the inner surface of the upper cover 20, for accommodating the tip ends of the wire insulation displacement portion 9 of the insulation displacement terminals 2. By the accommodation of the tip end of the wire insulation displacement portion 9 into a hole 34, it is possible to prevent the wire insulation displacement portion 9 from being interfered with by the wire holder 4 when the wire holder 4 is mounted to the connector housing 3. There are locking hooks 35*a* on an outside surface 35 of the upper cover 20, engageable with the locking claws 16 provided on the inner surface of the respective side wall 15 of the holder opening 14. By the engagement of the locking claws 16 with the locking hooks 35*a*, the wire holder 4 is engaged with the connector housing 3 whereby the fixed state of the wire holder 4 is maintained. Cover 20 further includes rails 36 extending across holes 34.

Then, a method for assembling the insulation displacement connector 1 according to this embodiment will be described below. The insulation displacement connector 1 is supplied from the maker in a form of a sub-assembled intermediate product to the user wherein it is assembled to be a complete product. As shown in FIG. 1, the sub-assembled insulation displacement connector 1 is in a state wherein the wire holder 4 consisting of the pair of upper and lower covers 20, 21 is temporarily held on the connector housing 3 in which four insulation displacement terminals 2 are laterally arranged on one line. The pair of upper and lower covers 20, 21 has a clearance between both the covers to facilitate the insert of the wires 5. This clearance is eliminated after the wire holder 4 is fully fixed as described later so that the wires 5 are prevented from sliding out of the wire holder 4. As shown in FIG. 8, a clearance also exists between the wire holder 4 and the connector housing 3, whereby the rotary piece 24 provided in the lower cover 21 is suspended obliquely by using this clearance. Thus, the wire-inserting port 22 (see FIG. 9) of the wire holder 4 is opened without disturbing the insertion of the wire 5 into the wire-inserting port 22.

The sub-assembled insulation displacement connector 1 is assembled on the user side to be a complete product. During the assembly, wires 5 having a predetermined thickness and an optional length are prepared by the user, in accordance with the application aspects of the connector 1. The wires 5 thus prepared may be, for example, those cut directly from a continuous wire wound on a wire reel (not shown) to have an optional length. That is, the cut wire 5 is used as it is without being subjected to a so-called wire-end treatment wherein the insulation cover of the wire end is peeled off to expose the wire core 5*a*.

As shown in FIG. 8, a plurality of wires 5 in correspondence to the number of insulation displacement terminals 2 are inserted from a rear end opening of the wire holder 4; i.e., from an inserting end of the wire inserting port 22 (see FIG. 9) to an innermost side thereof. An end of the wire 5 thus inserted is held by the pair of holding pieces 27*a*, 27*a* projected from a front wall surface 27 of the lower cover 21, and an intermediate portion of the wire 5 is located in a tapered portion in the inlet of the pair of insulation displacement edges 10, 10. In this state, the wire 5 is not yet brought into contact with the insulation displacement terminal 2.

Figure 10:
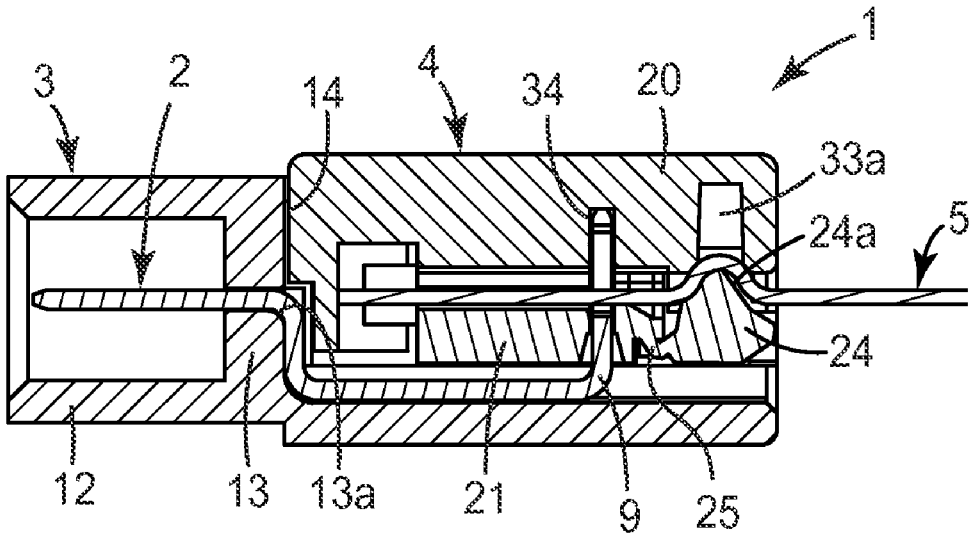
FIG. 10 A sectional view of the inventive insulation displacement connector illustrating a state after the wire holder is mounted to the connector housing.
Figure 11:
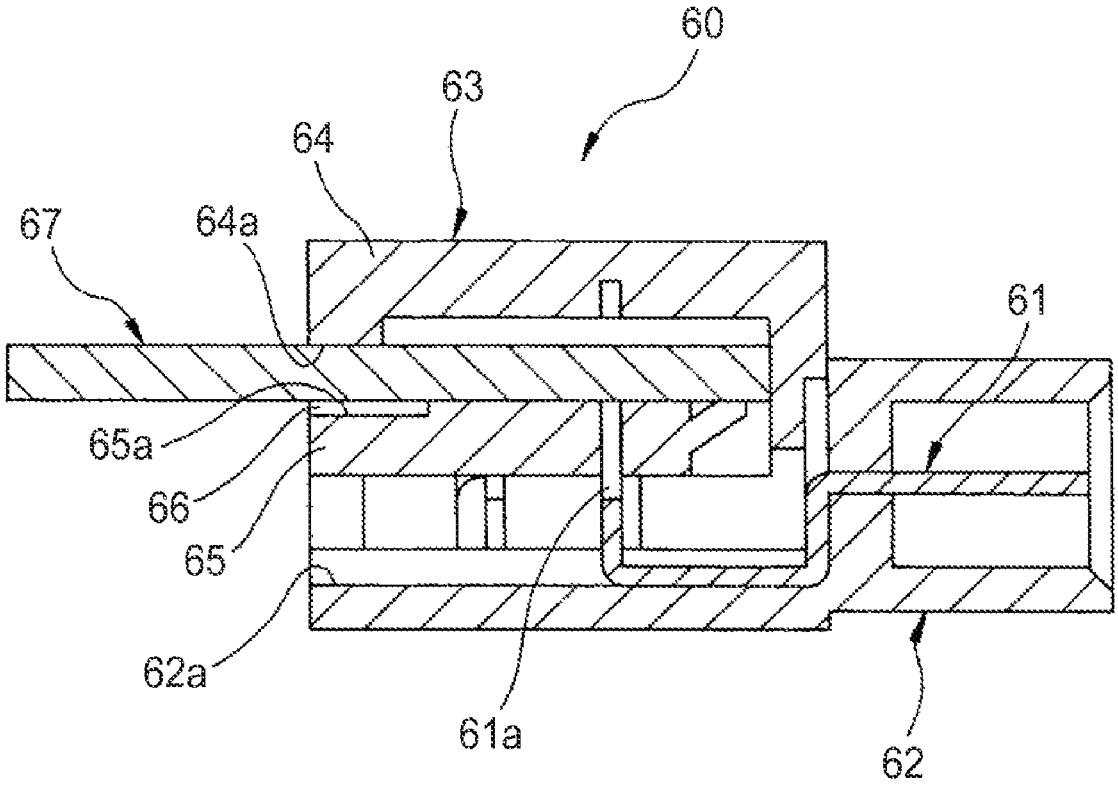
FIG. 11 Prior Art
FIG. 11 A lengthwise sectional view of the conventional insulation displacement connector.

As shown in FIG. 10, the press-contact of the wires 5 with the terminals 2 and the retention of the wires 5 by the rotary piece 24 occur generally at the same time as the wire holder 4 is fully fixed to the connector housing 3. That is, when the wire holder 4 is pushed into the holder opening 14 of the connector housing 3, the wires 5 are press-fit into the slits 10*a* of the wire insulation displacement portions 9 and the rotary piece 24 is made to rotate to fix the wires 5, resulting in the completion of the press-contact operation. As the wires 5 are fixed by the rotary piece 24, the press-contact operation proceeds while the tension is applied to the wires 5, whereby the lack of contact pressure is avoidable. The real fixation of the wire holder 4 is carried out by using a hand tool such as a plier. The hand tool is applied with a sufficient force to the insulation displacement terminals 2 with the press-contact force between the insulation displacement terminal 2 and the wire 5 so that the wire holder 4 is pushed into the holder opening 14 of the connector housing 3.

The press-contact of the wire 5 with the terminal 2 is proceeded simultaneously with the pushing operation of the wire holder 4 into the connector housing. That is, the wire 5 located at a position between the tapered portions of the pair of insulation displacement edges 10, 10 in the wire insulation displacement portion 9 is press-fit into the slit 10*a* by being pushed onto the inner wall surface of the upper cover 20. At that time, the wire 5 which covering 5*a* has been cut and torn by the edges 10 is pushed into the slit 10*a* having a width smaller than the outer diameter of the core wire, while widening the slit. In the slit 10*a*, the core wire exposed by the cutting/tearing of the covering 5*a* is electrically connected to the inner surface of the slit 10*a*. The wire 5 press-fit into the slit 10*a* is clamped by a counter force of the pair of insulation displacement edges 10, 10 within the elastically widened slit 10*a*, and retained there not to retreat in the direction opposite to the inserting direction as the cut and torn covering 5*a* is engaged with the inner edge of the slit 10*a*.

When the outer diameter of the core wire in the wire 5 press-fit into the wire insulation displacement portion 9 is the same, the wire 5 having a thicker covering 5*a* is better caught by the slit 10*a* than that having a thinner covering 5*a*. Accordingly, there is a risk that the latter may retreat in the direction opposite to the wire-inserting direction and finally come off from the wire holder 4 if the unintentional external force is applied to the wire 5. According to the present invention, however, as the wires 5 are secondarily engaged with the rotary piece 24, the retreat of the wires 5 is avoidable.

The secondary engagement of the wires 5 due to the rotary piece 24 is also carried out simultaneously with the pushing operation of the wire holder 4 into the connector housing 3. That is, when the wire holder 4 is pushed-in, the rotary piece 24 suspended from the lower cover 21 is pushed upward while being brought into contact with the inner wall surface of the connector housing 3, and is made to rotate about the hinge 25 to clamp the wires 5 between the upper cover 20 and the tip end of the rotary piece 24. The respective wire 5 is partially pressed by the projection 24*a* projected from the inner surface of the rotary piece 24 having an angled shape wherein the opposite side portion thereof is accommodated in the recess 33*a* of the upper cover 20. Accordingly, the wire 5 is secondarily engaged with the rotary piece 24 in the direction opposite to the wire-inserting direction, and prevented from sliding out of the wire holder 4 by an unintentional external force.

As described above, according to this embodiment of the present invention, as the rotary piece 24 is provided in the lower cover 21, rotating in association with the assembly of the pair of upper and lower covers 20, 21 in the wire holder 4 to clamp the wires 5, it is possible to smoothly insert the wires 5 into the wire holder 4 before the pair of upper and lower covers 20, 21 are assembled together, and to assuredly prevent the retreat of the wires 5 by the clamping action between the upper cover 20 and the rotary piece 24. Even if the wire is small in thickness and has a tendency of twisting or bending when it is inserted into the connector, such effects are maintained.

Note that the present invention should not be limited to the above-mentioned embodiment but may include other aspects. While the insulation displacement connector 1 has been described to be suitable for connecting thin wires, it may be used for connecting signal wires having an outer diameter of 1 mm or more. Also, according to this embodiment, while the rotary piece 24 is provided on the lower cover 21 via the hinge 25, the rotary piece 24 may be attached via a rotating pin.

The invention claimed is:

1. An insulation displacement connector, comprising:

an insulation displacement terminal in which a wire insulation displacement portion, to be electrically connected with an electrical wire, is formed by cutting and folding, a connector housing for holding said insulation displacement terminal therein and having an opening in an area in which said wire insulation displacement portion is located, and a wire holder having a pair of upper and lower covers capable of being assembled together by being mounted to said opening and holding said electrical wire between said pair of upper and lower covers, wherein said lower cover comprises a rotary piece attached thereto, said rotary piece being formed as one piece with the lower cover via a flexible hinge, directed downward not to cover wire-inserting ports of the wire holder, and configured to rotate inward about the flexible hinge when said lower cover is assembled with the upper cover so as to cooperate with said upper cover to clamp said electrical wire therebetween.

2. An insulation displacement connector as defined by claim 1, wherein said rotary piece comprises a projection projected from the inner surface of said rotary piece toward said upper cover, and said upper cover comprises a receiving groove provided in said upper cover for clamping said electrical wire in association with said projection when said upper cover is assembled with said lower cover.

3. An insulation displacement connector as defined by claim 2, wherein said receiving groove comprises a recess provided in part of a groove surface in said receiving groove at a position with reference to said projection.

4. An insulation displacement connector as defined by claim 2, wherein said projection and said receiving groove are shallowly intermeshed with each other before said upper and lower covers are assembled together.

5. An insulation displacement connector as defined claim 1, wherein said lower cover comprises a pair of holding pieces provided at an innermost end of said lower cover in the wire-inserting direction, for temporarily fixing said electrical wire inserted between said upper and lower covers.

* * * * *